US007540734B2

(12) United States Patent
Takayama et al.

(10) Patent No.: US 7,540,734 B2
(45) Date of Patent: Jun. 2, 2009

(54) PRESS MOLDER AND CUSHION RING

(75) Inventors: Norihiro Takayama, Aichi (JP); Yasuhito Hanaki, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 217 days.

(21) Appl. No.: 11/629,479

(22) PCT Filed: Jul. 22, 2005

(86) PCT No.: PCT/JP2005/013909

§ 371 (c)(1),
(2), (4) Date: Jan. 25, 2007

(87) PCT Pub. No.: WO2006/011585

PCT Pub. Date: Feb. 2, 2006

(65) Prior Publication Data

US 2008/0067320 A1 Mar. 20, 2008

(30) Foreign Application Priority Data

Jul. 29, 2004 (JP) ..... 2004-221866
Dec. 6, 2004 (JP) ..... 2004-353265

(51) Int. Cl.
*B29C 33/30* (2006.01)

(52) U.S. Cl. ..... 425/112; 425/125; 425/193; 425/344; 425/352; 425/468

(58) Field of Classification Search ..... 425/112, 425/125, 193, 577, 344, 352–355, 415–416, 425/423, 467–468, 400, 397, DIG. 48
See application file for complete search history.

(56) References Cited

U.S. PATENT DOCUMENTS 2,707,307 A * 5/1955 Brumbach ..... 425/406
3,611,517 A * 10/1971 Giersberg et al. ..... 425/346
4,534,725 A * 8/1985 Hemmelgarn et al. ..... 425/394
6,648,624 B1 * 11/2003 Foor et al. ..... 425/302.1

FOREIGN PATENT DOCUMENTS

JP 07-051796 A 2/1995
JP 2002-086219 A 3/2002
JP 2002-219528 A 8/2002
JP 2002-219529 A 8/2002

* cited by examiner

*Primary Examiner*—Yogendra Gupta
*Assistant Examiner*—Thu Khanh T Nguyen
(74) *Attorney, Agent, or Firm*—Kenyon & Kenyon LLP

(57) ABSTRACT

The problem of a conventional press molder is insufficient rigidity of an annular cushion ring receiving inward force, which cannot prevent a lower portion of the cushion ring from deforming, i.e., bending and expanding outward. A press molder (1) according to the present invention comprises a die (2), a punch (3) and a cushion ring (5). The cushion ring (5) has a rib (51) which is a reinforcing structure so as to be prevented from being bent at the time of press molding, and the punch (3) is formed therein with a recess (31) which is a reinforcing structure a escape part so as to prevent the punch 3 from interfering with the rib (51) of the cushion ring (5).

18 Claims, 32 Drawing Sheets

PRESS MOLDER AND CUSHION RING

This is a 371 national phase application of PCT/JP2005/013909 filed 22 Jul. 2005, claiming priority to Japanese Patent Applications No. 2004-221866 filed 29 Jul. 2004 and No. 2004-353265 filed 6 Dec. 2004, the contents of which are incorporated herein by reference.

FIELD OF THE INVENTION

The present invention relates to a press molder comprising a die, a punch and a cushion ring, and relates to a cushion ring for a press molder. Especially, the present invention relates to a construction for preventing bending of the cushion ring.

BACKGROUND OF THE INVENTION

Conventionally, there is a well-known a press molder for draw molding, comprising a die, a punch and a cushion ring, which pinches a work piece between the die and the cushion ring and presses the work piece on the punch disposed oppositely to the die so as to perform molding, as disclosed in the Japanese Patent Laid Open Gazette 2002-86219, for example.

As shown in FIGS. 30 and 31, such a press molder comprises a die 102 which is an upper mold, a punch 103 disposed oppositely to the die 102, a lower mold 104 constructed integrally with the punch 103, and a cushion ring 105 annularly disposed around the punch 103.

Such a press molder may comprise a plurality of cushion rings. For example, a press molder shown in FIG. 32 comprises a first cushion ring 105 and a second cushion ring 106 disposed inside the first cushion ring 105.

At the time of molding by moving the die 2 downward, a work piece W interposed between the die 102 and the punch 103 is pinched between a crease-suppression surface 102*a* of the die 102 and a crease-suppression surface 105*a* of the cushion ring 105 (in FIG. 32, a crease-suppression surface 105*a* of the first cushion ring 105 and a crease-suppression surface 106*a* of the second cushion ring 106) so as to prevent any crease or crack from being generated in the work piece W after the molding.

For preventing the bending at the time of draw molding, it is conceivable to provide a drawing mold with reinforcing structures, such as ribs. Conventionally, there is a well-known cast, such as a drawing mold, formed integrally with ribs, as disclosed in the Japanese Patent Laid Open Gazette Hei. 7-51796, for example.

SUMMARY OF THE INVENTION

Problems to Be Solved by the Invention

At the time of molding by the press molder shown in FIGS. 30 and 31, the die 102 is moved downward so as to pinch the work piece W between the crease-suppression surface 102*a* of the die 102 and the crease-suppression surface 105*a* of the cushion ring 105, and then the die 102 is moved further downward so as to press the work piece W on the punch 103, thereby molding the work piece W. Then, the work piece W is completely pinched between the die 102 and the punch 103 so as to finish the molding.

In the case of molding of the work piece W by pressing it on the punch 103, inward force is applied onto the processed portion of the work piece W, so that inward tensile force is also applied on the upper portion of the cushion ring 105 pinching the peripheral edge of the work piece W.

Since the inward force is applied on the upper portion of the cushion ring 105, the rigidity of the annular cushion ring 105 is insufficient, whereby the lower portion of the cushion ring 105 is bent and expanded outward, thereby being deformed. When the cushion ring 105 is deformed during molding, the crease-suppression surface 102*a* of the die 102 and the crease-suppression surface 105*a* of the cushion ring 105 become unfit to the work piece W. Accordingly, the work piece W cannot be pinched sufficiently, whereby a defect, such as crease or crack, tends to be generated in the work piece W after the molding.

With regard to the press molder shown in FIG. 32, the inner second cushion ring 106 having small contact area to other parts may lack stability in the attitude thereof, and may slant at worst. The slant second cushion ring 106 tends to cause abnormal abrasion of the die 102 and punch 103, crease or crack of the work piece W after the molding, or other problems.

Especially, when a large work piece, such as a side panel of a car, is draw-molded, the insufficiency of the rigidity of the cushion ring 105 causing the deform of the cushion ring 105 becomes remarkable.

With regard to the drawing mold disclosed in the Japanese Patent Laid Open Gazette Hei. 7-51796, the ribs are provided for absorbing casting stress generated during casting of the drawing mold so as to prevent the drawing mold from being deformed. After finishing processing of the drawing mold, the ribs are removed. Therefore, the ribs cannot prevent the drawing mold from being deformed at the time of the press molding.

Means for Solving the Problems

An object of the present invention is to provide a construction for preventing bending of a cushion ring of a press molder, the press molder comprising a die, a punch and the cushion ring.

A press molder of the present invention comprises a die, a punch and a cushion ring. The cushion ring has a reinforcing structure so as to be prevented from being bent during press molding, and the punch is formed therein with a reinforcing structure escape part so as to be prevented from interfering with the reinforcing structure of the cushion ring. Accordingly, the rigidity of the cushion ring is improved, thereby preventing the cushion ring from being bent and deformed during molding a work piece. Therefore, any crease or crack is prevented from being generated in the work piece after the molding without any complicated adjustment work, thereby improving the accuracy of the molding. Due to the improved rigidity of the cushion ring, the cushion ring is also prevented from being bent by processing force during mechanical processing of the cushion ring, thereby improving the accuracy of the mechanical processing of the cushion ring. Further, a lower mold below the work piece can be omitted except for the punch, thereby entirely compacting the press molder.

The reinforcing structure is provided at a portion of the cushion ring opposite to a surface of the cushion ring to abut against the die. Accordingly, the effect of preventing bending is enhanced.

The reinforcing structure is a rib spanned in an opening of the cushion ring. Accordingly, the reinforcement requires no other special material or work, thereby preventing the cost of the press molder from increasing.

The reinforcing rib is formed integrally with the cushion ring or fastened to the cushion ring by a fastening member. Accordingly, the cushion ring is reinforced stably so as to effectively suppress bending of the cushion ring.

Alternatively, the reinforcing structure is a wire spanned in an opening of the cushion ring. Accordingly, the weight of the reinforcements can be reduced and the tension (reinforcement force) can be set relatively easily. Furthermore, by adjusting the tension of the reinforcements, the reinforcement degree of the cushion ring can be adjusted relatively easily.

The wire has adjustable tensile force. Accordingly, the tension can be adjusted optimally corresponding to the strength of the inward force applied on the upper portion of the cushion ring, whereby bending of the cushion ring can be suppressed effectively so as to achieve the molding with high accuracy.

A downwardly extending leg part is formed on a lower end of the punch, and an attachment hole to which a hook member is attached is formed on a side surface of the punch, so that, when the punch and the cushion ring are put on the same floor, the attachment hole is positioned above the cushion ring. Accordingly, when the punch and the cushion ring are put on the same floor, the hook member can be attached to the side surface of the punch so as to be hung for hoisting the punch.

A cushion pin is disposed below the cushion ring so as to support a main body and the reinforcing structure of the cushion ring.

Accordingly, even if inward force is applied on the upper portion of the cushion ring, the reinforcing structure is prevented from being bent.

The cushion ring comprises a plurality of cushion rings. The plurality of cushion rings are connected to each other through a reinforcing structure, and the plurality of cushion rings are slidably engaged with the punch. Accordingly, the rigidity of each cushion ring is improved, thereby preventing the cushion ring from bending and deforming at the time of molding the work piece. Furthermore, attitude-disarrangement of the cushion ring can be suppressed during molding. Accordingly, any crease or crack is prevented from being generated in the work piece after the molding without any complicated adjustment work, thereby improving the accuracy of the molding. Further, the cushion rings are prevented being bent by processing force during mechanical processing of the cushion rings, thereby improving the accuracy of the mechanical processing of the cushion ring.

The cushion ring comprises a plurality of cushion rings, one of the cushion rings is disposed around the punch, and another cushion ring is inserted in a cavity provided in the punch, and the one and the other cushion ring are connected to each other through an reinforcing structure. Accordingly, the rigidity of each cushion ring is improved, thereby preventing the cushion ring from bending and deforming at the time of molding the work piece. Furthermore, attitude-disarrangement of the cushion ring can be suppressed during molding. Accordingly, any crease or crack is prevented from being generated in the work piece after the molding without any complicated adjustment work, thereby improving the accuracy of the molding. Since the rigidity of the cushion rings is improved, the cushion rings are also prevented from being bent by processing force at the time of mechanical processing of the cushion rings, thereby improving the accuracy of the mechanical processing of the cushion rings.

The reinforcing structure is provided opposite to faces of cushion rings making contact with the die. Accordingly, the effect of preventing bending of cushion rings is enhanced.

The reinforcing structure is a rib formed in between one of the cushion rings and the other cushion ring. Accordingly, any other special material or work is not required for providing the reinforcements, thereby preventing the cost of the press molder from increasing.

The reinforcing rib is formed integrally with one of the cushion rings and the other cushion ring, or fastened to one of the cushion rings and the other cushion ring. Accordingly, those cushion rings are reinforced stably so as to effectively suppress bending and attitude-disarrangement of cushion rings.

A cushion ring provided in a press molder is characterized in that the cushion ring comprises a reinforcing structure for preventing the cushion ring from bending during press molding, wherein the reinforcing structure is spanned an opening of the cushion ring.

Accordingly, the rigidity of the cushion ring is improved, thereby preventing the cushion ring from bending and deforming during molding a work piece.

Therefore, any crease or crack is prevented from being generated in the work piece after the molding without any complicated adjustment work, thereby improving the accuracy of the molding.

Due to the improved rigidity, the cushion ring is also prevented from being bent by processing force during mechanical processing of the cushion ring, thereby improving the accuracy of the mechanical processing of the cushion ring.

A lower mold below the work piece except for a punch can be omitted so as to entirely compact the press molder.

The reinforcing structure is a rib spanned in an opening of the cushion ring.

Accordingly, any other special material or work is not required for providing the reinforcements, thereby preventing the cost of the press molder from increasing.

The rib is formed integrally with the cushion ring or fastened to the cushion ring by a fastening member.

Accordingly, the cushion ring is reinforced stably so as to effectively suppress bending of the cushion ring.

Alternatively, the reinforcing structure is a wire spanned in an opening of the cushion ring.

Accordingly, the weight of the reinforcements can be reduced and the tension (reinforcement force) can be set relatively easily. Furthermore, by adjusting the tension of the reinforcements, the reinforcement degree of the cushion ring can be adjusted relatively easily.

The wire has adjustable tensile force.

Accordingly, the tension can be adjusted optimally corresponding to the strength of the inward force applied on the upper portion of the cushion ring, whereby bending of the cushion ring can be suppressed effectively so as to achieve the molding with high accuracy.

EFFECT OF THE INVENTION

The press molder according to the present invention is provided with the cushion ring or rings having improved rigidity, thereby preventing the cushion ring or rings from bending and deforming during molding a work piece. Furthermore, attitude-disarrangement of the cushion ring or rings can be suppressed at the time of molding.

Therefore, any crease or crack is prevented from being generated in the work piece after the molding without any complicated adjustment work, thereby improving the accuracy of the molding.

Due to the improved rigidity, the cushion ring is also prevented from being bent by processing force at the time of mechanical processing the cushion ring, thereby improving the accuracy of the mechanical processing of the cushion ring.

A lower mold below the work piece except for the punch can be omitted so as to entirely compact the press molder.

Further, if the press molder comprises a plurality of cushion rings, each of the cushion rings has the above effects.

Furthermore, a cushion ring according to the present invention has improved rigidity, thereby being prevented from bending and deforming during molding the work piece.

Accordingly, any crease or crack is prevented from being generated in the work piece after the molding without any complicated adjustment work, thereby improving the accuracy of the molding.

Due to the improved rigidity, the cushion ring is also prevented from being bent by processing force at the time of mechanical processing of the cushion ring, thereby improving the accuracy of the mechanical processing of the cushion ring.

DESCRIPTION OF NOTATIONS

Figure 1:
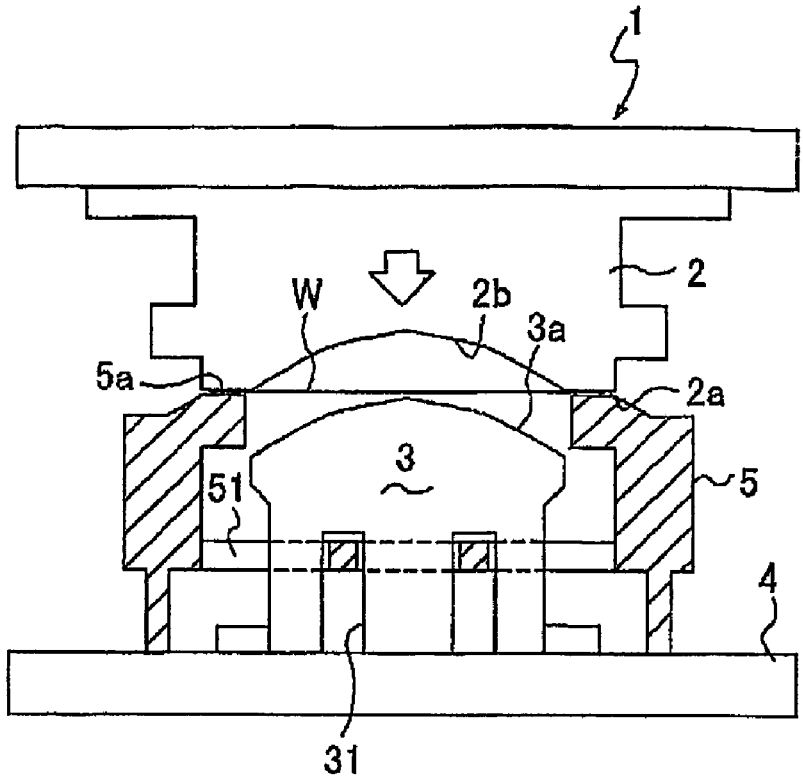
FIG. 1 is a sectional side view of a press molder according to the present invention.

W a work piece
1 a press molder
2 a die
3 a punch
5 a cushion ring
31 grooves
51 ribs

DETAILED DESCRIPTION

A mode for carrying out the present invention is explained on the basis of attached drawings.

Firstly, explanation will be given on a first embodiment of a press molder according to the present invention.

Figure 2:
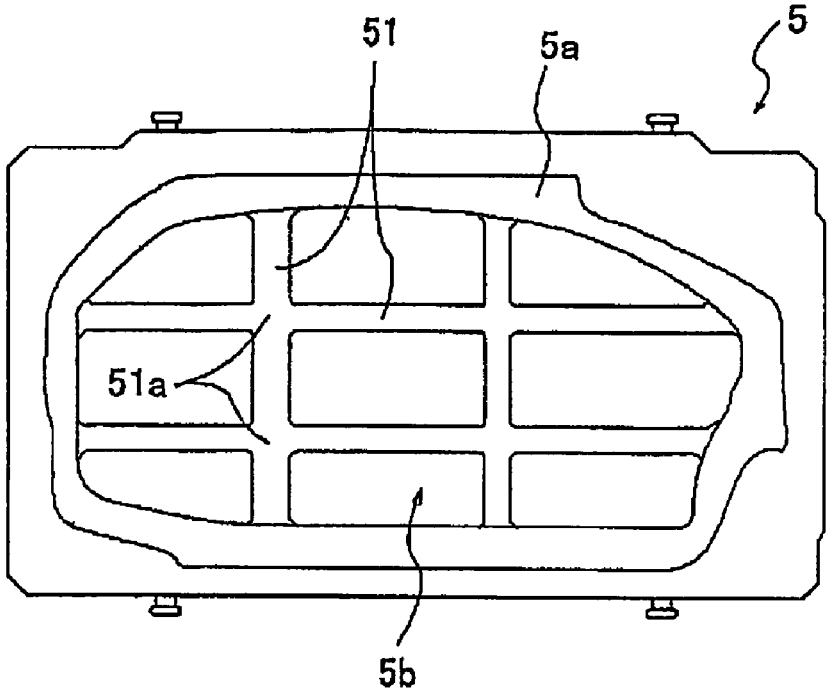
FIG. 2 is a plan view of a cushion ring provided in the press molder.

A press molder 1 for draw-molding, shown in FIGS. 1 and 2, comprises a die 2 which is an upper mold, a punch 3 disposed to face to the die 2 (in FIG. 1, disposed below the die 2), and a cushion ring 5 annularly disposed around the punch 3.

The die 2 is vertically movable, and the cushion ring 5 can follow the die 2 (that is, the cushion ring 5 is vertically movable so as to follow the vertical movement of the die 2).

The cushion ring 5 and the punch 3 are disposed on an upper surface of a bolster 4.

A crease-suppression surface 2*a* is formed at the peripheral lower surface of the die 2, and a crease-suppression surface 5*a* is formed on the upper surface of the cushion ring 5, at the position corresponding to the crease-suppression surface 2*a* of the die 2 so that the crease-suppression surface 2*a* can abut against the crease-suppression surface 5*a*.

A plate-like work piece W, which is a processed member, is interposed between the die 2 and the punch 3. When the work piece W is molded by the press molder 1, firstly, the die 2 is moved downward so that the peripheral edge of the work piece W is pinched between the crease-suppression pressure surface 2*a* of the die 2 and the crease-suppression pressure surface 5*a* of the cushion ring 5 (the state shown in FIG. 1).

Figure 3:
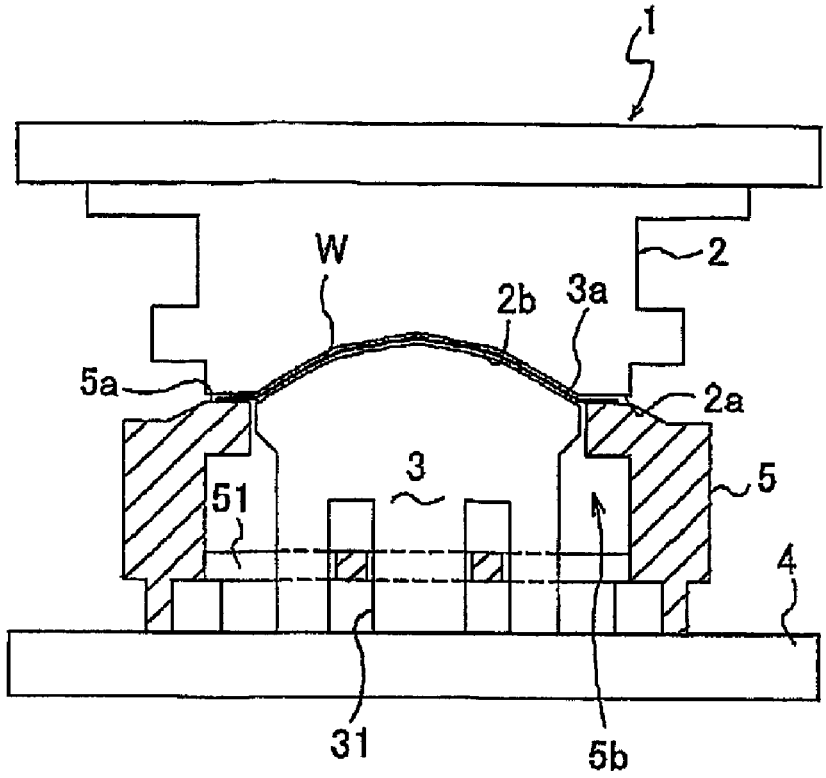
FIG. 3 is a sectional side view of the press molder molding a work piece when the work piece is completely pinched between processing surfaces of a punch and a die.

Then, the die 2 is moved further downward so as to press and transform the work piece W on a processing surface 3*a* of the punch 3, thereby molding the work piece W. As shown in FIG. 3, when the work piece W comes to be completely pinched between the processing surface 3*a* of the punch 3 and a processing surface 2*b* of the die 2, the molding is completed.

At this time, the cushion ring 5 is moved downward together with the die 2 while keeping on pinching the work piece W.

The cushion ring 5 is provided with an opening 5*b*, and a plurality of ribs 51 are spanned between inner peripheral surfaces of the cushion ring 5 in a lower portion of the opening 5*b* so as to serve as reinforcements of the cushion ring 5. For example, each of the ribs 51 connects substantially opposite inner peripheral surfaces of the cushion ring 5 in the lower portion of the opening 5*b*, and the ribs 51 are integrally connected to one another at intersecting points 51*a* thereof.

The punch 3 is fitted into the opening 5*b* of the cushion ring 5, and formed at the lower portion thereof with a recess 31 so as to prevent the interference with the ribs 51. The recess 31 is formed corresponding to the form of the ribs 51 formed in the cushion ring 5.

When the work piece W is pressed and transformed on the processing surface 3*a* of the punch 3 by the downward movement of the die 2, the processed portion of the work piece W receives force so as to be moved inward, therefore inward tensile force is also applied on the upper portion of the cushion ring 5 pinching the peripheral edge of the work piece W.

Figure 30:
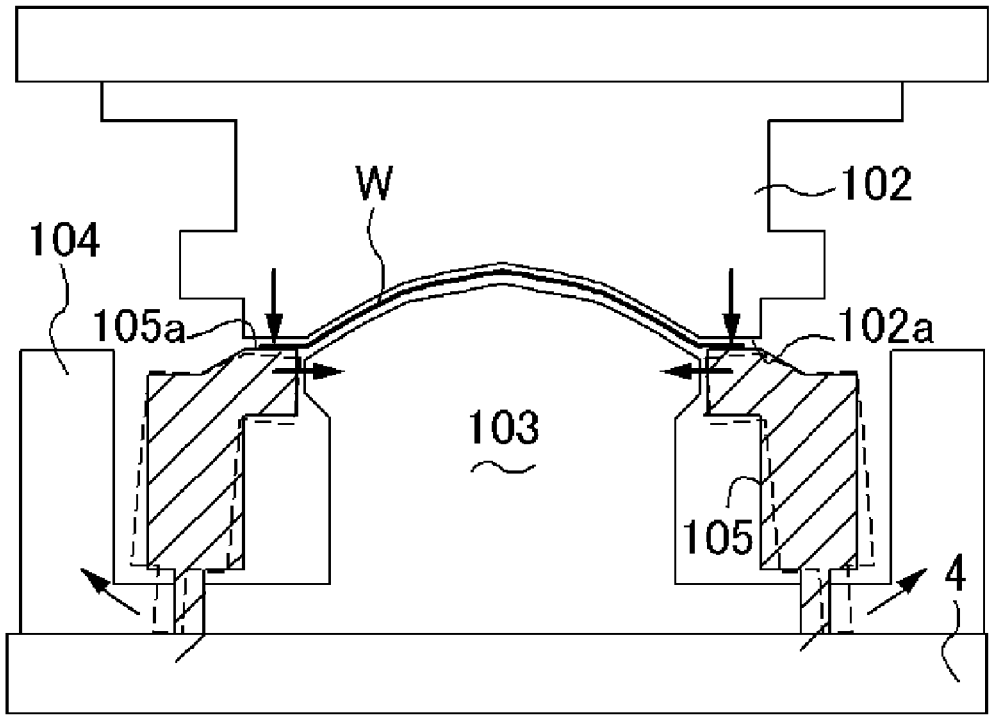
Prior Art Fig. 30
FIG. 30 is a sectional side view of a conventional press molder.
Figure 31:
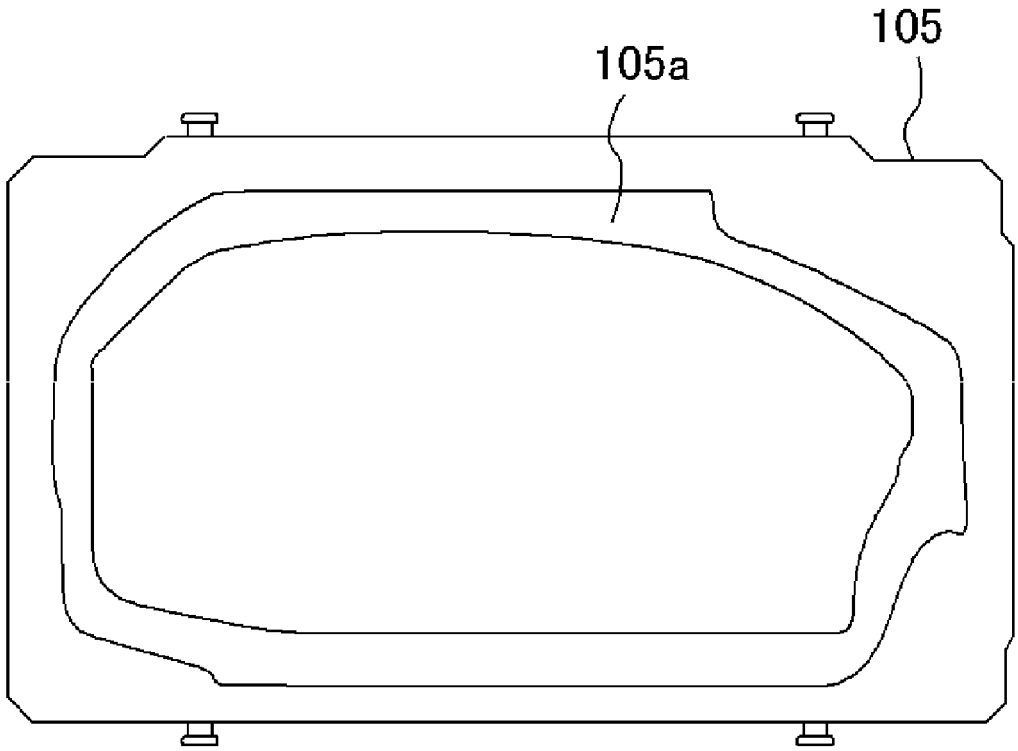
Prior Art Fig. 31
FIG. 31 is a plan view of a conventional cushion ring.

A cushion ring 105 having no reinforcement as shown in FIGS. 30 and 31 may be bent and expand outward when the inward tensile force is applied on the upper portion of the cushion ring 105. On the contrary, the cushion ring 5 is prevented from bending due to the plurality of ribs 51 spanned in the lower portion of the opening 5*b*.

Accordingly, by providing the ribs 51 as reinforcements inside the opening 5*b* of the cushion ring 5, the rigidity of the cushion ring 5 is improved, thereby preventing the cushion ring 5 from bending and deforming during molding the work piece W. Therefore, any crease or crack is prevented from being generated in the work piece W after the molding without any complicated adjustment work, thereby improving the accuracy of the molding.

Further, due to the improved rigidity of the cushion ring 5, the cushion ring 5 can be prevented from being bent by processing force during mechanical processing of the cushion ring 5, thereby improving the accuracy of the mechanical processing of the cushion ring 5.

Especially, the ribs 51 are spanned in the lower portion of the cushion ring 5 opposite to the upper portion thereof on which inward force is applied, so as to enhance the effect of the ribs 51 for preventing bending of the cushion ring 5.

The ribs 51 as reinforcements for the cushion ring 5 can be formed integrally with the cushion ring 5 simultaneously with casting of the cushion ring 5. Accordingly, any other special material or work is not required for providing the reinforcements, thereby preventing the cost of the press molder 1 from increasing.

With regard to the conventional press molder shown in FIG. 30, a lower mold 104 and a punch 103 are disposed below the work piece W. However, with regard to the press molder 1, a lower mold below the work piece is omitted, and only the punch 3 is disposed below the work piece, thereby compacting the whole press molder 1.

Figure 4:
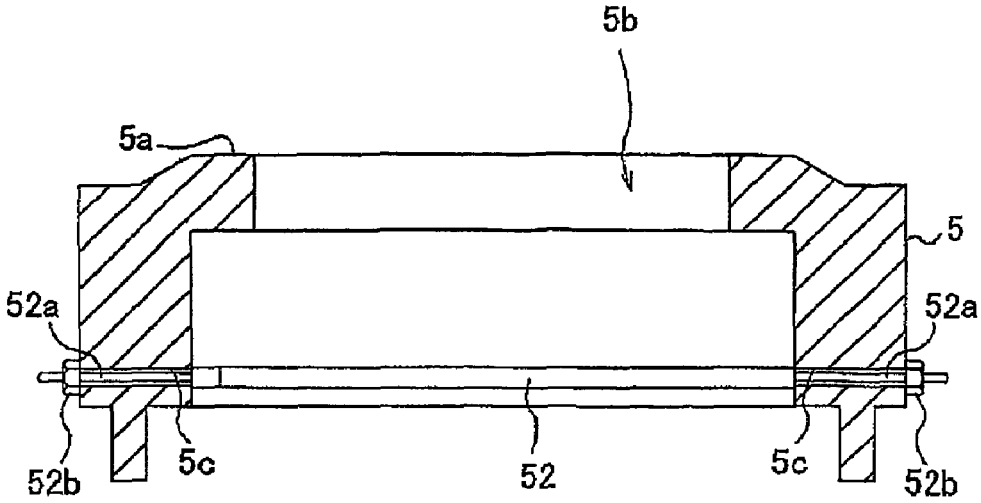
FIG. 4 is a sectional side view of a second embodiment of reinforcements for the cushion ring.

The ribs 51 provided in the cushion ring 5 as reinforcements are formed integrally with the cushion ring 5. Alternatively, as shown in FIG. 4, reinforcing bars 52, which are constructed separately from the cushion ring 5, may be spanned in the opening 5*b*.

Supporting parts 52*a* project from both ends of each reinforcing bar 52 respectively, and each of the supporting parts 52*a* is inserted into a supporting hole 5*c* formed in the lower portion of the cushion ring 5. A screw thread is formed on the tip of the supporting part 52*a*, and the tip projects outside the cushion ring 5. A fastening member such as a nut is fastened on each of the tips of the supporting part 52*a* projecting outside so as to span the reinforcing bar 52 in the opening 5*b*.

Accordingly, the reinforcing bars 52, made of metal or other rigid material, are fastened to the cushion ring 5 and spanned in the opening 5*b*, so that the reinforcements provided in the cushion ring 5 can be relatively easily changed in position and number.

By the rigid reinforcements such as the ribs 51 or the reinforcing bars 52, the cushion ring 5 is reinforced stably so as to effectively suppress bending of the cushion ring 5.

Figure 5:
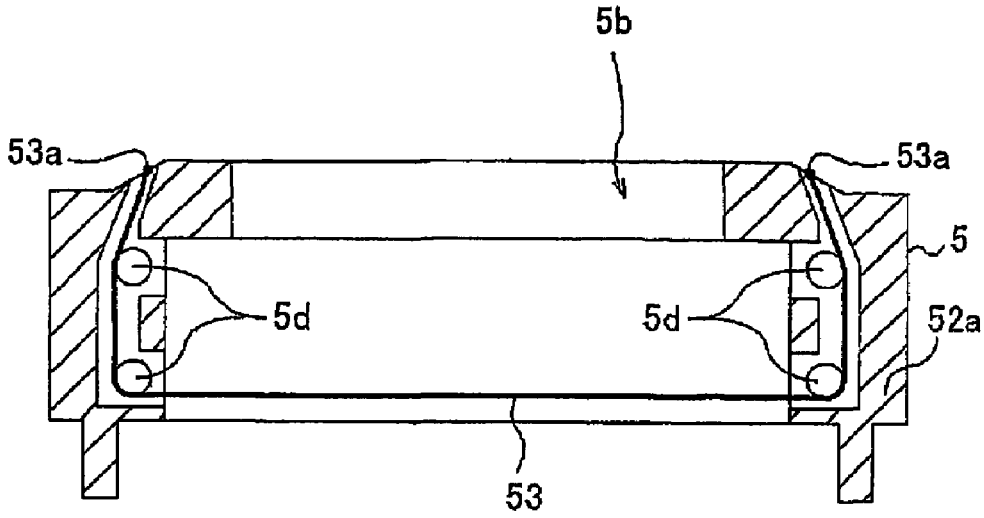
FIG. 5 is a sectional side view of a third embodiment of reinforcements for the cushion ring.

Alternatively, as shown in FIG. 5, the reinforcements provided in the opening 5*b* may be wires 53 spanned in the opening 5*b*.

For example, each of the wires 53 is fixed at both ends 53*a* thereof to the upper portion of the cushion ring 5, and is looped over rollers 5*d* provided in the cushion ring 5, whereby the wire 53 is spanned in the lower portion of the opening 5*b*.

The cushion ring 5 having the wires 53 braced in the opening 5*b* is also effectively prevented from bending.

By using the braced wires 53 as the reinforcements, the weight of the reinforcements can be reduced and the tension (reinforcement force) can be set relatively easily. Furthermore, by adjusting the tension of the wires 53, the reinforcement degree of the cushion ring 5 can be adjusted relatively easily.

Figure 6:
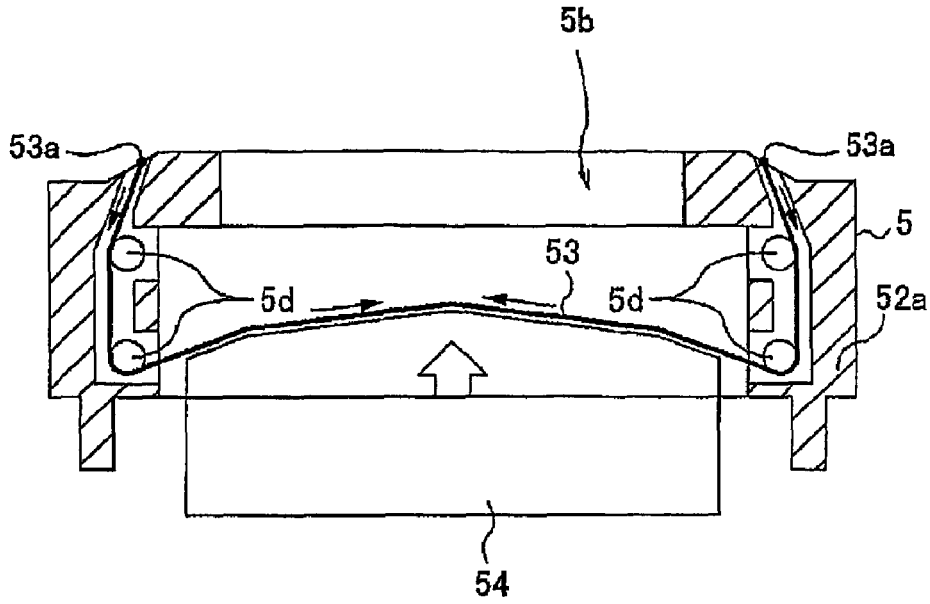
FIG. 6 is a sectional side view of the reinforcement of FIG. 5 with a wire whose tension is controllable.

With regard to the adjustment of tension in the case of constructing the reinforcements by the wires 53, as shown in FIG. 6 for example, a projection 54 is projected upward into the cushion ring 5 so as to touch the wires 53, and the touching degree thereof is controlled so as to adjust the tension of the wires 53.

According to this construction, the tension of the wires 53 can be adjusted actively. The tension can be adjusted optimally corresponding to the strength of the inward force applied on the upper portion of the cushion ring 5, whereby bending of the cushion ring 5 can be suppressed effectively so as to achieve the molding with high accuracy.

Figure 7:
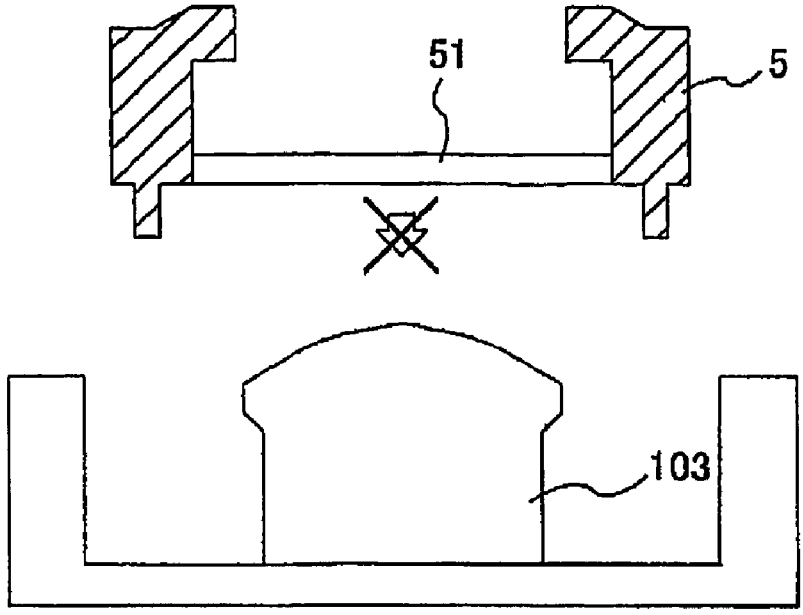
FIG. 7 is a sectional side view of the cushion ring of the present invention, a conventional punch, and a lower molder, showing that the cushion ring according to the present invention cannot be fitted downward to the conventional punch and lower mold.

With regard to the conventional press molder, the cushion ring is fitted downward to the punch 103 disposed below. However, as shown in FIG. 7, if the cushion ring is replaced with the cushion ring 5 having the reinforcing ribs 51 according to the present invention, the cushion ring 5 cannot be fitted downward to the punch 103 because the punch 103 interferes with the ribs 51.

Figure 8:
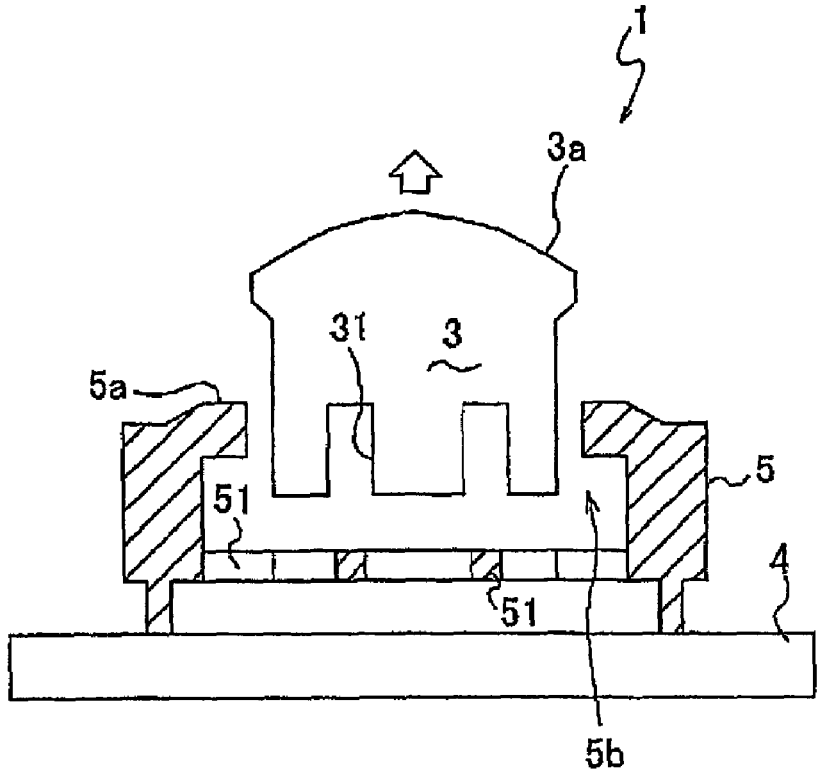
FIG. 8 is a sectional side view of a punch constructed so as to be able to be pulled out upward from the cushion ring.

Therefore, as shown in FIG. 8, with regard to the press molder 1, grooves 31 are formed at positions of the lower portion of the punch 3 overlapping the position of the ribs 51 so as to prevent the punch 3 from interfering with the ribs 51 at the time of fitting the cushion ring 5 to the punch 3, and to be able to pull up the punch 3 outward from the fixed cushion ring 5.

For pulling out the punch 3 upward as the above, a hook must be attached to the punch 3 so as to be hung with a hoisting wire or the like. The hook is inserted or screwed into a hole formed on the punch 3. The hole cannot be formed on the processing surface 3*a* of the punch 3, which determines the processing form of the work piece W. The hole must be formed on a vertical side surface of the punch 3.

Figure 9:
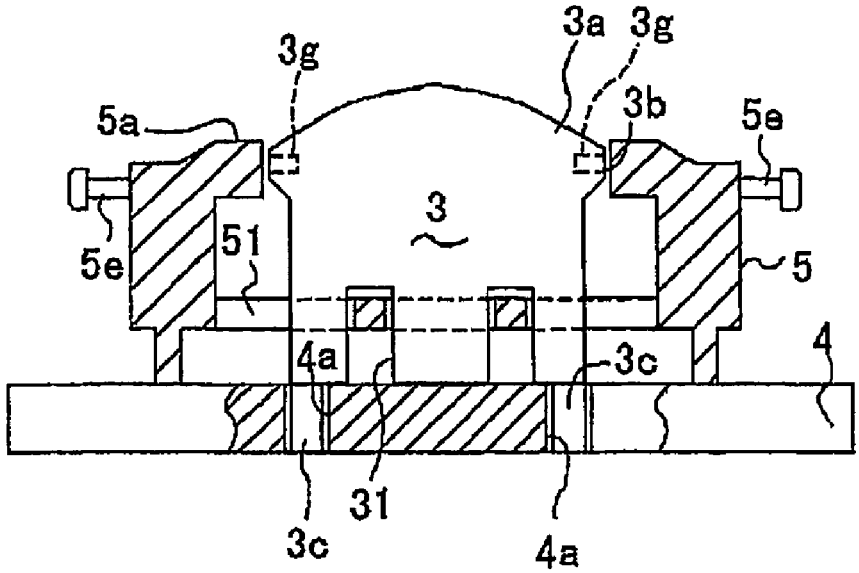
FIG. 9 is a sectional side view of the punch additionally provided thereon with leg parts during molding.
Figure 10:
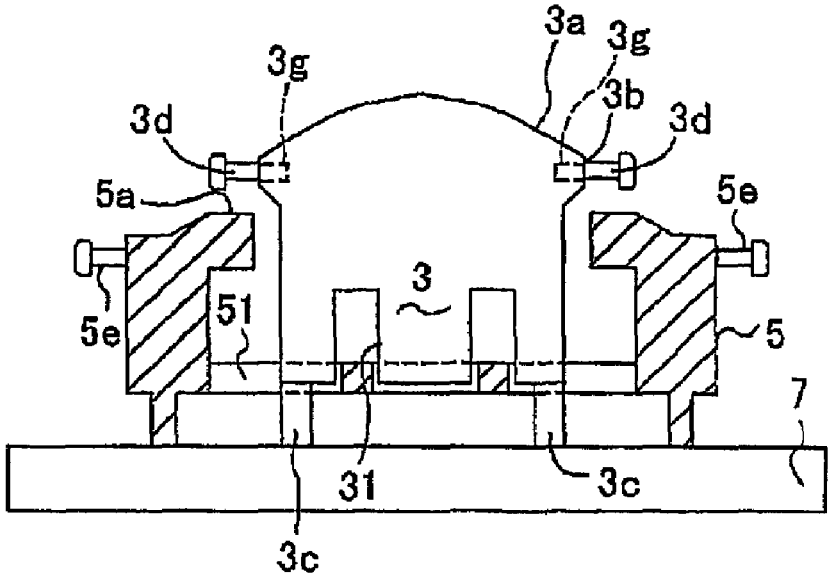
FIG. 10 is a sectional side view of the punch with the leg parts before assembling of the press molder.
Figure 11:
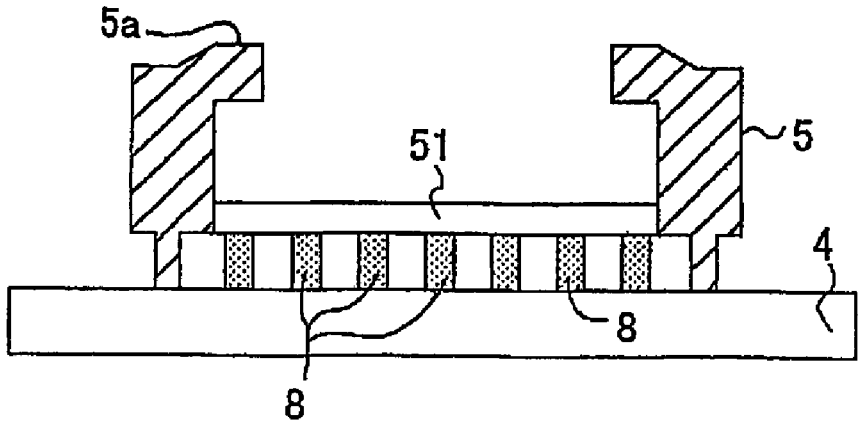
FIG. 11 is a sectional side view of the cushion ring whose ribs are supported by cushion pins.

However, as shown in FIG. 9, if hook attachment holes 3*g* formed on the side surface 3*b* of the punch 3 are covered by the cushion ring 5, the hooks cannot be inserted into the hook attachment holes 3*g*.

Therefore, with regard to the whole press molder 1, leg parts 3*c* are formed to extend downward from the lower end of the punch 3, so that hooks 3*d* can be attached to the side surface 3*b* of the punch 3.

In this regard, leg insertion holes 4*a* are formed in the bolster 4. During molding of the work piece W, the legs 3*c* of the punch 3 are inserted into the leg insertion holes 4*a*, whereby only the processing surface 3*a* of the punch 3 is exposed upward from the cushion ring 5 while the side surface 3*b* is covered by the cushion ring 5.

Then, at work before assembling of the press molder 1, such as during die change, the punch 3 is suspended together with the cushion ring 5 and carried to another place so as to be put on a horizontal floor 7. In addition, the punch 3 and the cushion ring 5 are hoisted and carried by hanging on hooks 5*e*, which are attached to the outer peripheral surface of the cushion ring 5.

As shown in FIG. 1, when the punch 3 and the cushion ring 5 are put on the horizontal floor 7, the height of the punch 3 relative to the cushion ring 5 is increased by the height of the leg parts 3*c*, whereby the side surface 3*b* of the punch 3, on which the hook attachment holes 3*g* are opened, is positioned above the cushion ring 5.

Since the side surface 3*b* is positioned above the cushion ring 5, the hooks 3*d* to be hung can be attached to the side surface 3*b* of the punch 3 so as to suspend and pull out the punch 3.

With regard to the press molder 1, a plurality of upwardly biased cushion pins 8 are disposed below the cushion ring 5 so as to support cushion ring 5. Since the cushion ring 5 is provided therein with the ribs 51, the cushion pins 8 supports not only the main body of the cushion ring 5 but also the ribs 51 serving as the reinforcements of the cushion ring 5.

Figure 12:
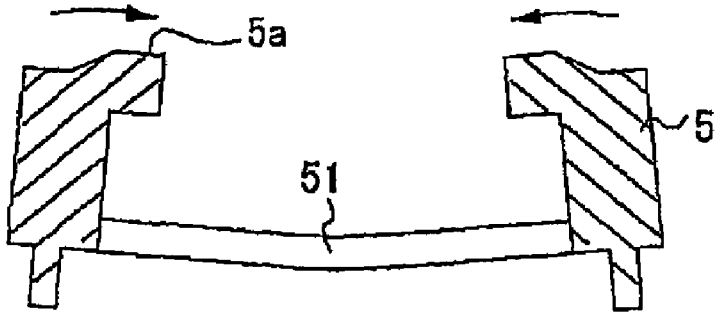
FIG. 12 is a sectional side view of the cushion ring whose ribs are bent by inward force applied on the upper portion of the cushion ring.

As shown in FIG. 12, when inward force is applied on the upper portion of the cushion ring 5, there is a fear of bending of the ribs 51. However, the bending of the ribs 51 is prevented due to the cushion pins 8 upwardly supporting the cushion ring 5 with the main body and reinforcing ribs 51.

Figure 13:
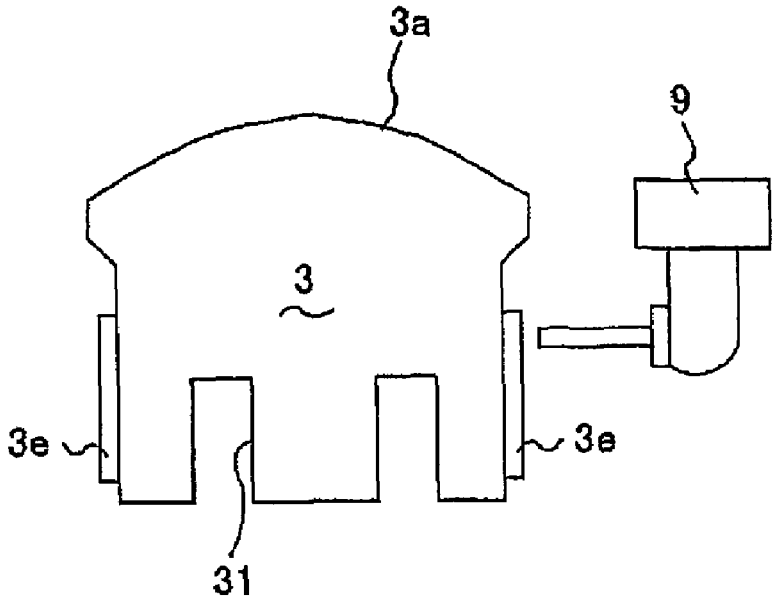
FIG. 13 is a side view of the punch processed therein with tap holes for attaching slide seats thereto by a tap drill.

As shown in FIG. 13, it is necessary that the side surface of the punch 3 is tapped by a tap drill 9 so as to fasten slide seats 3*e*, on which the cushion ring 5 is slidable, to the side surface of the punch 3.

Contrary to the conventional press molder having the lower mold 104 around the punch 103, the press molder 1 does not have any lower mold around the punch 3. Accordingly, the punch 3 can be easily and quickly tapped because there is not the problem of the lower mold 104 around the punch 103 which interferes with the tap drill 9 so as to make the tapping difficult.

Figure 14:
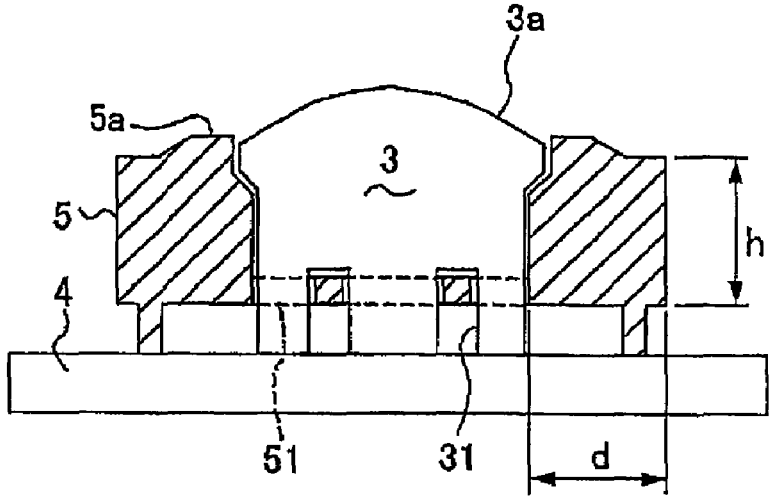
FIG. 14 is a sectional side view of the cushion ring, showing thickness dimension and height dimension of the cushion ring.

With regard to the press molder 1, the punch 3 is not combined with the lower mold 104 combined with the conventional punch 103, so that only the punch 3 is to be pulled up outward from the cushion ring 5. Accordingly, as shown in FIG. 14, the thickness dimension d and the height dimension h of the cushion ring 5 can be large so as to increase the rigidity of the cushion ring 5.

Next, explanation will be given on a second embodiment of a press molder according to the present invention.

Figure 15:
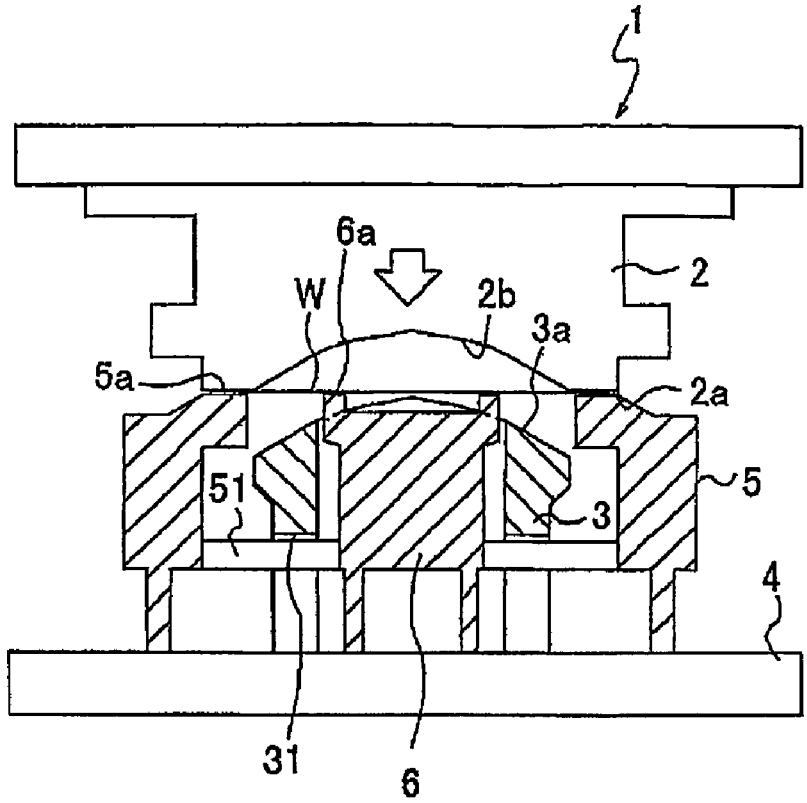
FIG. 15 is a sectional side view of a press molder of a second embodiment according to the present invention.
Figure 16:
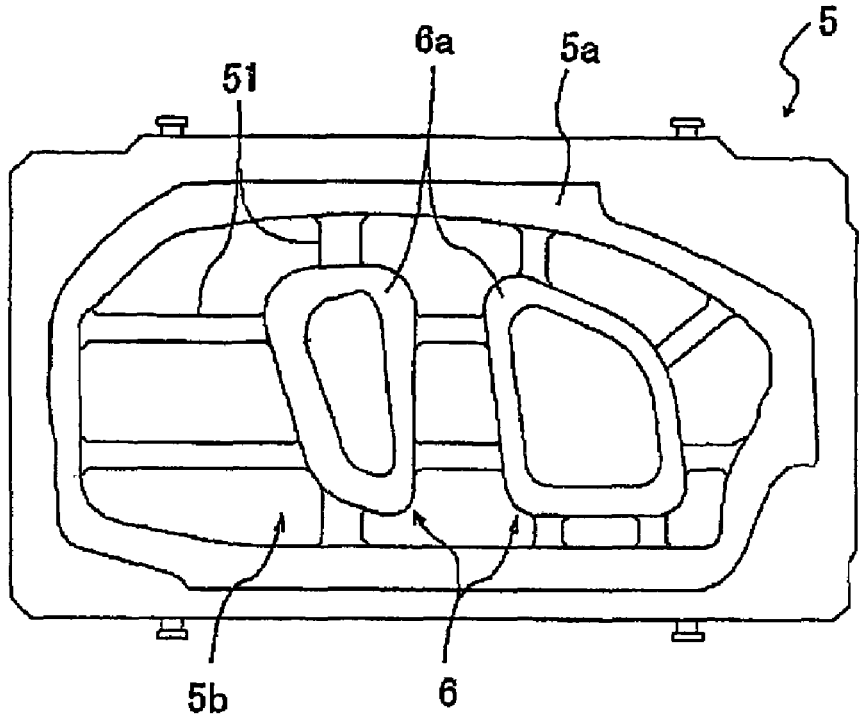
FIG. 16 is a plan view of a cushion ring provided in the press molder.
Figure 17:
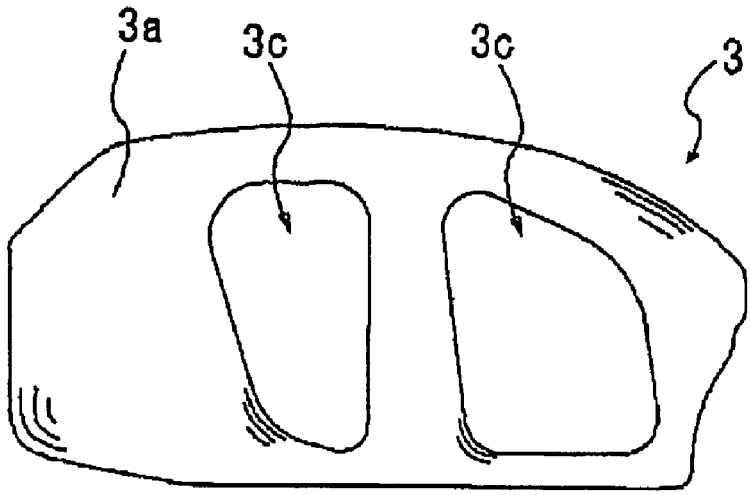
FIG. 17 is a plan view of a punch provided in the press molder.

A press molder 1 for draw-molding, shown in FIGS. 15 to 17, comprises a die 2 which is an upper mold, a punch 3 disposed to face to the die 2 (in FIG. 15, disposed below the die 2), a first cushion ring 5 annularly disposed around the punch 3, and a second cushion ring 6 disposed at the inner peripheral side of the first cushion ring 5.

The die 2 is vertically movable. The first cushion ring 5 and the second cushion ring 6 can follow the die 2 (that is, the cushion rings are vertically movable so as to follow the vertical movement of the die 2).

The first cushion ring 5, the second cushion ring 6 and the punch 3 are disposed on an upper surface of a bolster 4. The punch 3 is disposed in a space 5*b* between the first cushion ring 5 and the second cushion ring 6, and is formed to fit the space 5*b*.

Crease-suppression surfaces 5*a* and 6*a* are formed on the upper surfaces of the first cushion ring 5 and the second cushion ring 6, respectively. A crease-suppression surface 2*a* is formed on the lower surface of the die 2, at the position corresponding to the crease-suppression surfaces 5*a* and 6*a* of the first cushion ring 5 and the second cushion ring 6 so that the crease-suppression surface 2*a* can abut against the crease-suppression surfaces 5*a* and 6*a*.

In addition, the portion of the crease-suppression surface 2*a* corresponding to the crease-suppression surface 5*a* of the first cushion ring 5 is formed on the bottom surface of the peripheral portion of the die 2.

A plate-like work piece W, which is a processed member, is interposed between the die 2 and the punch 3. When the work piece W is molded by the press molder 1, firstly, the die 2 is moved downward so that the peripheral edge of the work piece W is pinched between the crease-suppression surface 2*a* of the die 2 and the crease-suppression surface 5*a* of the first cushion ring 5 (the state shown in FIG. 15). At this state, the work piece W is also pinched between the crease-suppression surface 2*a* of the die 2 and the crease-suppression surface 6*a* of the second cushion ring 6.

Figure 18:
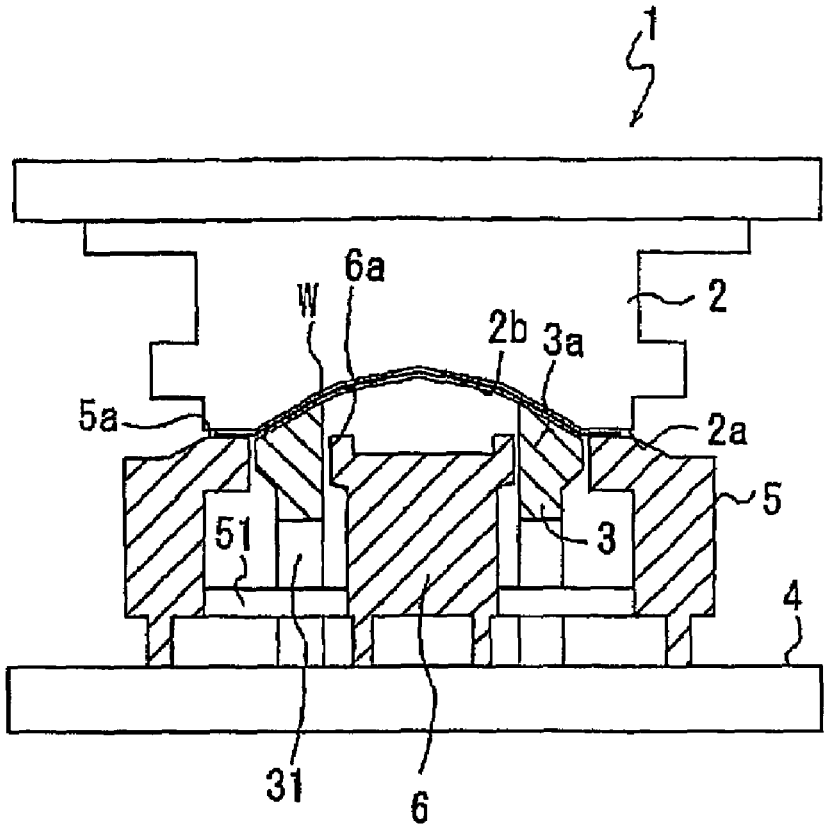
FIG. 18 is a sectional side view of the press molder molding a work piece when the work piece is completely pinched between processing surfaces of the punch and a die.

Then, the die 2 is moved further downward so as to press and transform the work piece W on a processing surface 3*a* of the punch 3, thereby molding the work piece W. As shown in FIG. 18, when the work piece W comes to be completely pinched between the processing surface 3*a* of the punch 3 and the crease-suppression surface 2*b* of the die 2, the molding is completed.

At this time, the first cushion ring 5 and the second cushion ring 6 are moved downward together with the die 2 while keeping on pinching the work piece W.

A plurality of ribs 51 is formed in the space 5*b* between the first cushion ring 5 and the second cushion ring 6. Each of the ribs 51 is connected between a lower inner peripheral surface of the first cushion ring 5 and a lower outer peripheral surface of the second cushion ring 6.

The ribs 51, spanned between the first cushion ring 5 and the second cushion ring 6 as the above, effect as reinforcing structures for the first cushion ring 5 and the second cushion ring 6.

The punch 3 is vertically slidably fitted into the space 5*b* between the first cushion ring 5 and the second cushion ring 6. The second cushion ring 6 is vertically slidably fitted into a hollow 3*c* formed in the punch 3. Namely, the first cushion ring 5 and the second cushion ring 6 are slidably fitted to the punch 3.

A recess 31 is formed in the lower portion of the punch 3 to be fitted into the space 5*b* between the first cushion ring 5 and the second cushion ring 6, so as to prevent interference of the punch 3 with the ribs 51.

In this regard, the recess 31 is formed correspondingly to the form of the ribs 51 formed in the cushion ring 5 so as to prevent the punch 3 from interfering with the ribs 51 at the state that the first cushion ring 5, the second cushion ring 6 and the punch 3 are put on the bolster 4.

When the work piece W is pressed and transformed on the processing surface 3*a* of the punch 3 by the downward movement of the die 2, the processed portion of the work piece W receives force so as to be moved inward, therefore inward tensile force is also applied on the upper portion of the first cushion ring 5 pinching the peripheral edge of the work piece W.

Figure 32:
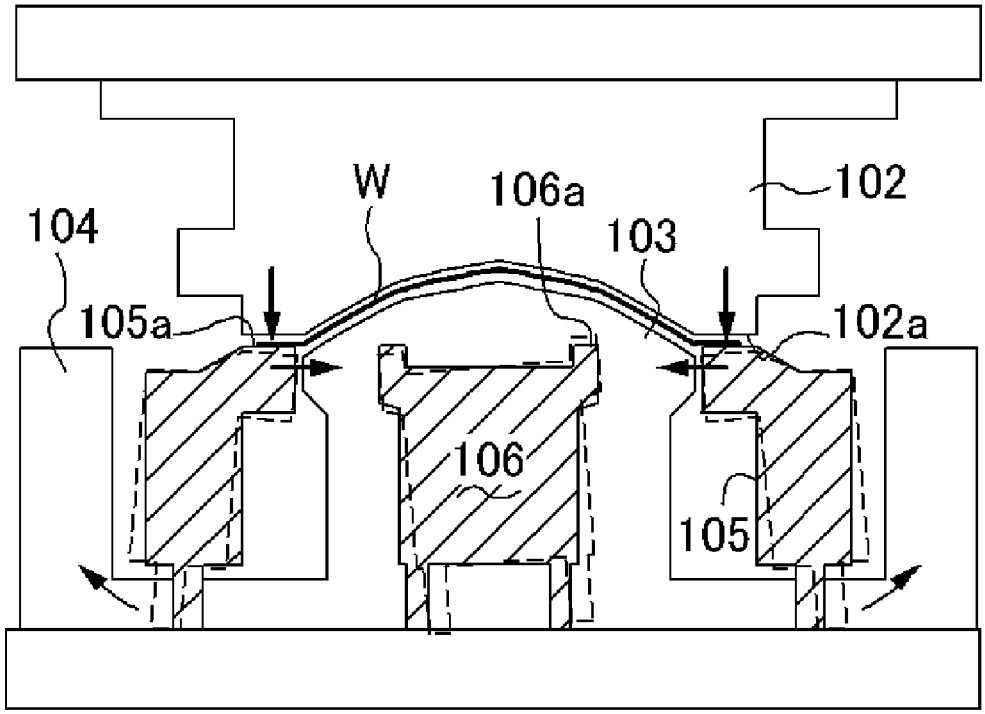
Prior Art Fig. 32
FIG. 32 is a sectional side view of another embodiment of a conventional press molder.

A cushion ring 105 having no reinforcement as shown in FIGS. 31 and 32 may be bent and expand outward when the inward tensile force is applied on the upper portion of the cushion ring 105. On the contrary, the cushion ring 5 is prevented from bending due to the plurality of ribs 51 spanned in the lower portion of the opening 5*b*.

Since the first cushion ring 5 is provided with the reinforcing ribs 51 in the space 5*b* between the first cushion ring 5 and the second cushion ring 6 so as to be connected to the second cushion ring 6, the rigidity of the first cushion ring 5 is improved, thereby preventing the first cushion ring 5 from bending and deforming at the time of molding the work piece W.

Figure 19:
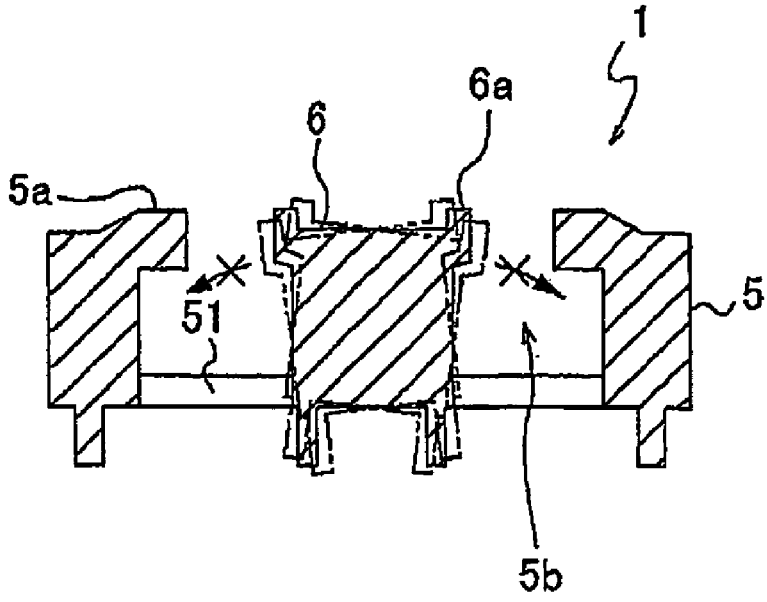
FIG. 19 is a sectional side view of first and second cushion rings showing that ribs of the first cushion rings are connected to the second cushion ring so as to suppress attitude-disarrangement of the second cushion ring.

As shown in FIG. 19, the ribs 51 also reinforce the second cushion ring 6, thereby suppressing attitude-disarrangement of the second cushion ring 6 when force is applied on the second cushion ring 6 during the molding.

Accordingly, any crease or crack is prevented from being generated in the work piece W after the molding without any complicated adjustment work, thereby improving the accuracy of the molding.

Due to the improved rigidity of the first cushion ring 5, the first cushion ring 5 and the second cushion ring 6 are prevented from being bent by processing force during mechanical processing of the cushion rings 5 and 6, thereby improving the accuracy of the mechanical processing of the cushion rings 5 and 6.

Especially, the ribs 51 are spanned in the lower portions of the first and second cushion rings 5 and 6, opposite to the upper portions of the first and second cushion rings 5 and 6 on which inward force is applied, thereby enhancing the effect of the ribs 51 for preventing bending of the cushion rings 5 and 6.

The ribs 51 as reinforcing structures for the first and second cushion rings 5 and 6 can be formed integrally with the first and second cushion rings 5 and 6 simultaneously with casting the cushion rings 5 and 6. Accordingly, any other special material or work is not required for providing the reinforcing structures, thereby preventing the cost of the press molder 1 from increasing.

With regard to the conventional press molder shown in FIG. 32, a punch 103 and a lower mold 104 are disposed below the work piece W. However, with regard to the press molder 1, a lower mold is omitted and only the punch 3 is disposed below the work piece W, thereby compacting the whole press molder 1.

Figure 20:
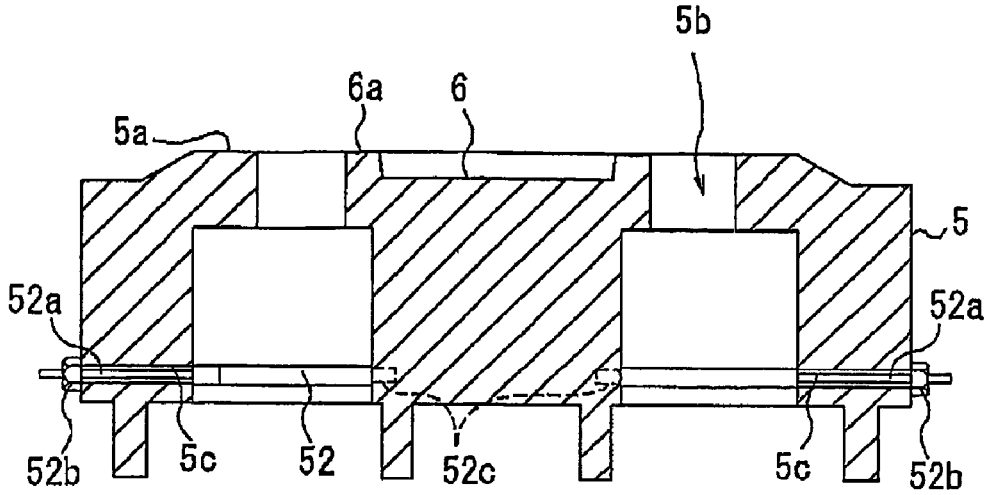
FIG. 20 is a sectional side view of a second embodiment of a reinforcement for the cushion ring.

The ribs 51 provided between the first cushion ring 5 and the second cushion ring 6 as reinforcing structures are formed integrally with the first and second cushion rings 5 and 6. Alternatively, as shown in FIG. 20, reinforcing bars 52, which are constructed separately from the first and second cushion rings 5 and 6, may be spanned in the space 5*b*.

In this regard, a supporting part 52*a* is formed at one of ends of each reinforcing bar 52, and is inserted into a supporting hole 5*c* formed in the lower portion of the first cushion ring 5. A screw part 52*c* is formed at the other end of the reinforcing bar 52, and is screwed to the second cushion ring 6.

A screw thread is formed on each of the tips of the supporting part 52*a*, and the tip projects outside the first cushion ring 5. A fastening member such as a nut is fastened on the tip of the supporting part 52*a* projecting outside the first cushion ring 5.

Accordingly, the reinforcing bars 52 are spanned in the space 5*b* of the first cushion ring 5.

Accordingly, in this embodiment, the reinforcing bars 52, which are metal or other rigid members, are spanned between the first cushion ring 5 and the second cushion ring 6 so that the spanned reinforcing structures can be relatively easily changed in position and number.

By the rigid reinforcements such as the ribs 51 or the reinforcing bars 52, the cushion ring 5 and the second cushion ring 6 are reinforced stably so as to effectively suppress bending of the cushion ring 5 and attitude-disarrangement of the second cushion ring 6.

Figure 21:
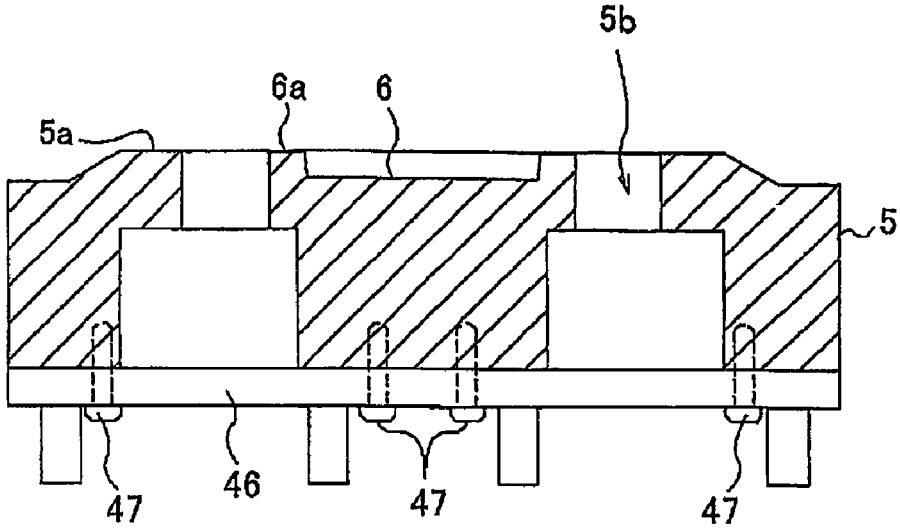
FIG. 21 is a sectional side view of a third embodiment of a reinforcement for the cushion ring.

Alternatively, as shown in FIG. 21, a base plate 46 may be provided as a reinforcing structure for the first cushion ring 5 and the second cushion ring 6. The first cushion ring 5 and the second cushion ring 6 are fastened to a base plate 46 by bolts 47 or the like.

In this case, the base plate 46 effects as a reinforcing structure which connects the first cushion ring 5 to the second cushion ring 6.

Figure 22:
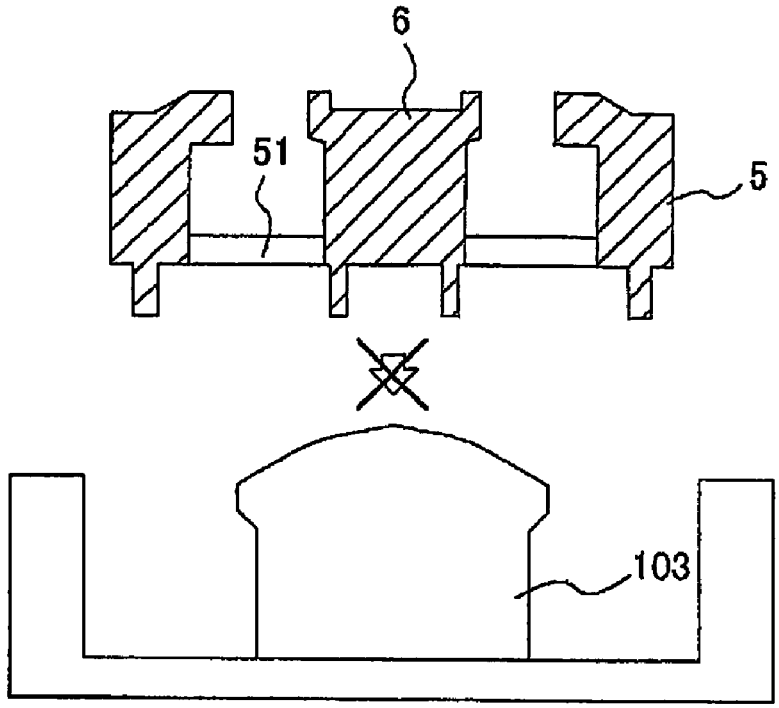
FIG. 22 is a sectional side view of the cushion ring and conventional punch and lower mold, showing that the cushion ring according to the present invention cannot be fitted downward to the conventional punch and lower mold.

With regard to the conventional press molder, the cushion ring is fitted downward to the punch 103 disposed below. However, as shown in FIG. 22, if the cushion ring is replaced with the first and second cushion rings 5 mutually connected through the reinforcing ribs 51 according to the present invention, the first and second cushion rings 5 and 6 cannot be fitted downward to the punch 103 because the punch 103 interferes with the ribs 51.

Figure 23:
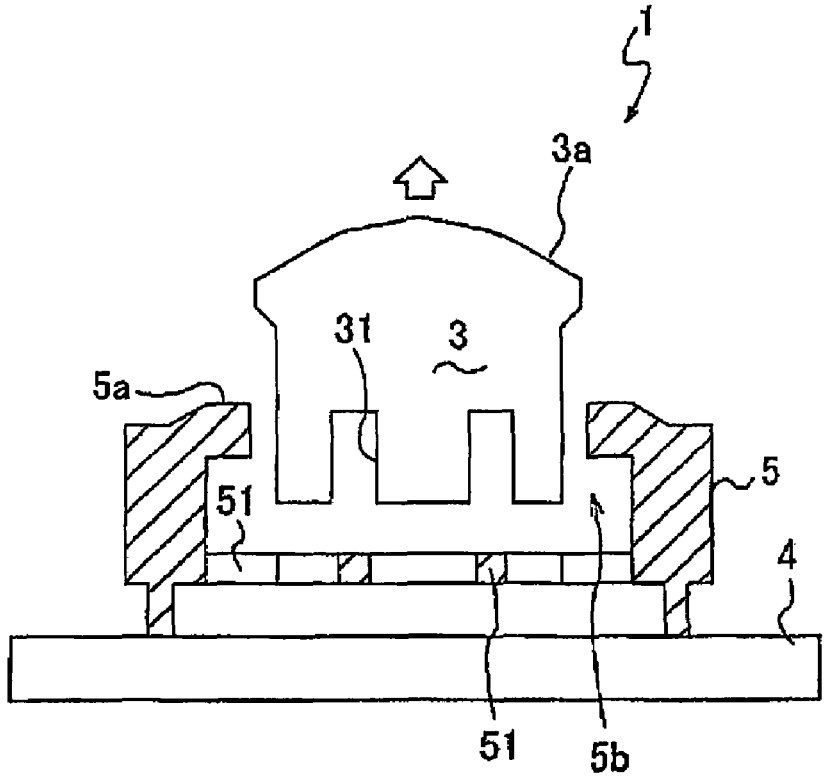
FIG. 23 is a sectional side view of a punch constructed so as to be able to be pulled out upward from the cushion ring.

Therefore, as shown in FIG. 23, with regard to the press molder 1, grooves 31 are formed at positions of the lower portion of the punch 3 overlapping the position of the ribs 51 so as to prevent the punch 3 from interfering with the ribs 51 at the time of fitting the first and second cushion rings 5 and 6 to the punch 3, and to be able to pull up the punch 3 out from the fixed cushion rings 5 and 6.

In addition, in FIG. 23, the second cushion ring 6 is omitted and only the first cushion ring 5 is shown.

For pulling out the punch 3 upward as the above, a hook must be attached to the punch 3 so as to be hung with a hoisting wire or the like. The hook is inserted or screwed into a hole formed on the punch 3. The hole cannot be formed on the processing surface 3*a* of the punch 3, which determines the processing form of the work piece W. The hole must be formed on a vertical side surface of the punch 3.

Figure 24:
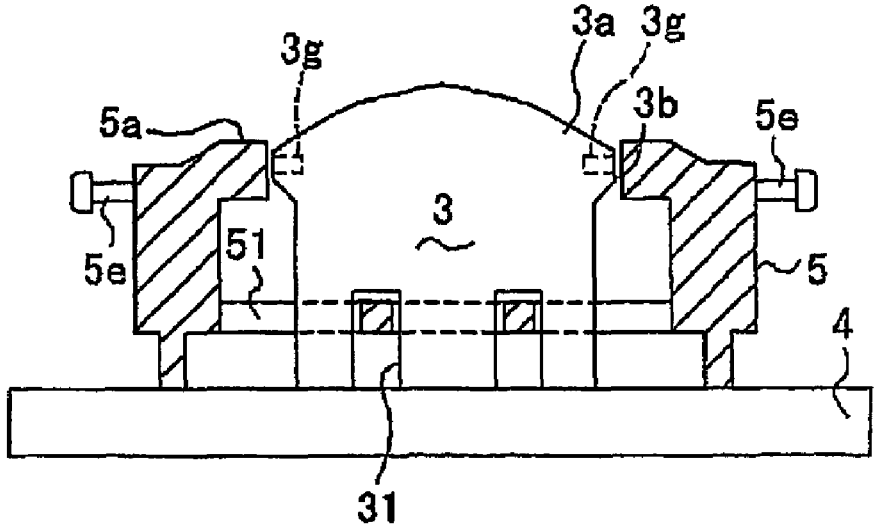
FIG. 24 is a sectional side view of the punch additionally provided thereon with leg parts during molding.

However, as shown in FIG. 24 (in this drawing, the second cushion ring 6 is omitted), if hook attachment holes 3*g* formed on the side surfaces 3*b* of the punch 3 are covered by the cushion ring 5, the hooks cannot be inserted into the hook attachment holes 3*g*.

Figure 25:
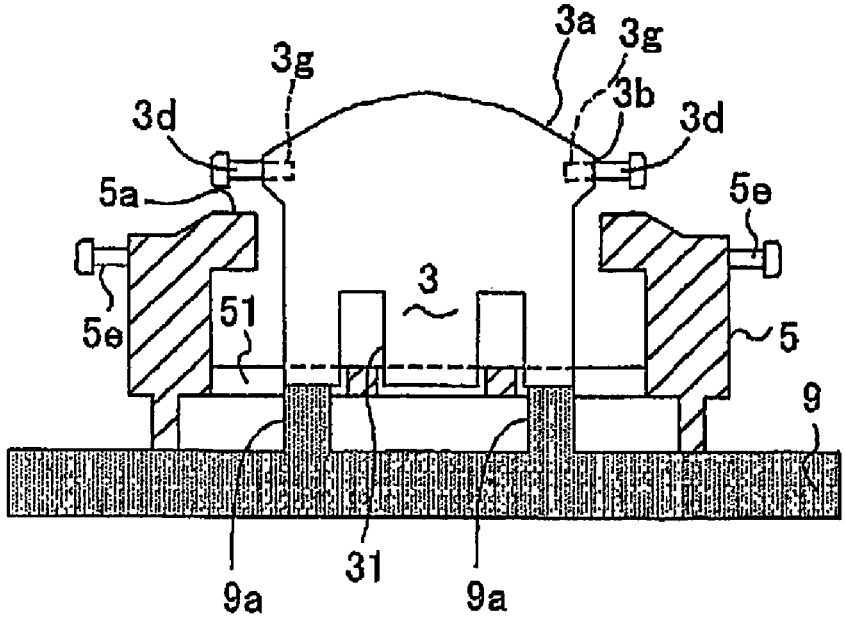
FIG. 25 is a sectional side view of the punch with the leg parts before assembling of the press molder.

Therefore, with regard to the press molder 1 of this embodiment, the first cushion ring 5, the second cushion ring 6 and the punch 3 are put on a mold base 9 having leg parts 9*a* as shown in FIG. 25 (in this drawing, the second cushion ring 6 is omitted), so that the hooks 3*d* can be attached to the side surface 3*b* of the punch 3.

In this regard, during the molding of the work piece W, the first cushion ring 5, the second cushion ring 6 and the punch 3 are put on the plate-like bolster 4, whereby only the processing surface 3*a* of the punch 3 is exposed upward from the first cushion ring 5 while the side surface 3*b* is covered by the first cushion ring 5.

At work before assembling of the press molder 1 for die change or the like, the punch 3 is hoisted together with the first and second cushion rings 5 and 6 and carried so as to be put on the mold base 9 on another place.

In addition, hooks 5*e* are attached to the outer peripheral surface of the cushion ring 5 so as to be hung for hoisting and carrying the punch 3 and the first cushion ring 5.

The leg parts 9*a* of the mold base 9 are formed at a portion of the mold base 9 on which the punch 3 is put. The punch 3 put on the leg parts 9*a* becomes higher relative to the first and second cushion rings 5 and 6.

Accordingly, the side surface 3*b* of the punch 3 on which the hook attachment holes 3*g* are opened is positioned above the first cushion ring 5.

By positioning the side surface 3*b* of the punch 3 above the first cushion ring 5, the hooks 3*d* can be attached to the side surface 3*b* of the punch 3 so as to be hung for pulling up the punch 3.

On the contrary, when the punch 3 is set with the first and second cushion rings 5 and 6, the hooks 3*d* shown in FIG. 25 are removed, and then the punch 3 is hoisted together with the first and second cushion rings 5 and 6 and carried so as to be put on the bolster 4.

Figure 26:
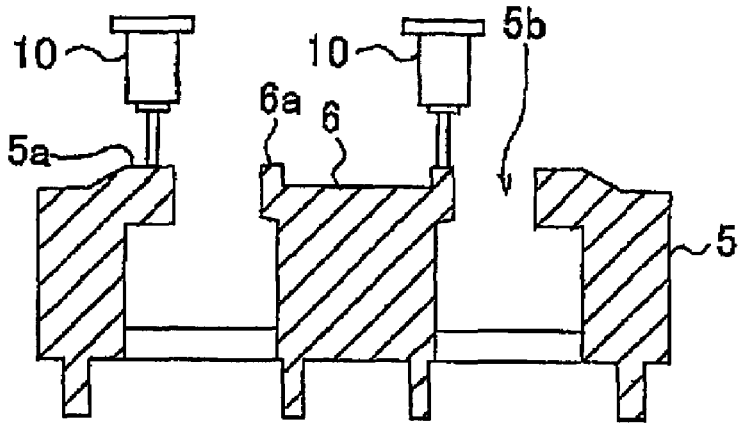
FIG. 26 is a sectional side view of the first and second cushion rings, showing that they can be mechanically processed simultaneously.

As shown in FIG. 26, with regard to the press molder 1, the first cushion ring 5 and the second cushion ring 6 are connected to each other by the ribs 51 or the like, therefore the first cushion ring 5 and the second cushion ring 6 are mechanically processed simultaneously by a mechanical processor 10.

For example, the first cushion ring 5 and the second cushion ring 6 can be set on the same jig simultaneously so as to be mechanically processed. Accordingly, the first cushion ring 5 and the second cushion ring 6 can be mechanically processed with high accuracy, thereby improving the press accuracy of the press molder 1.

If the first cushion ring 5 and the second cushion ring 6 are not connected to each other and constructed independently, both of the first cushion ring 5 and the second cushion ring 6 must be attached thereon with respective slide plates so as to be slidable against the punch 3.

Figure 27:
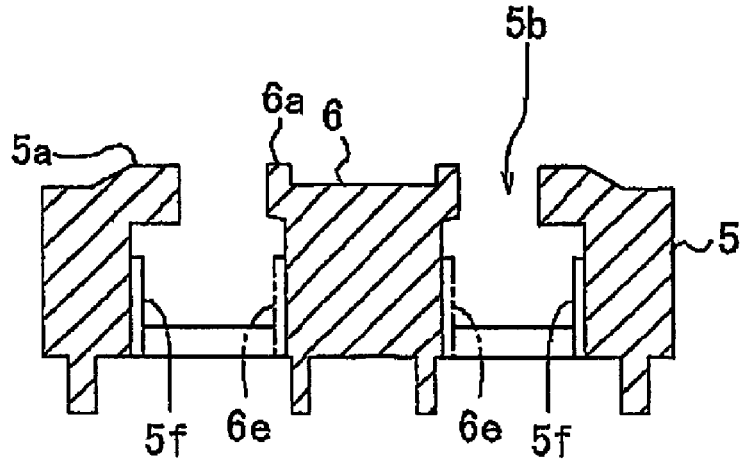
FIG. 27 is a sectional side view of the first and second cushion rings, showing that slide plates attached to the second cushion ring can be omitted.

However, with respect to the press molder 1, the first cushion ring 5 and the second cushion ring 6 are connected to each other by the ribs 51 so as to be integrally slidable. Accordingly, as shown in FIG. 27, slide plates 6*e* for the second cushion ring 6 are not necessary, and only slide plates 5*e* are necessary to be provided on the first cushion ring 5.

Therefore, parts constituting the press molder 1, especially parts to be exchanged for maintenance, can be reduced in number.

Figure 28:
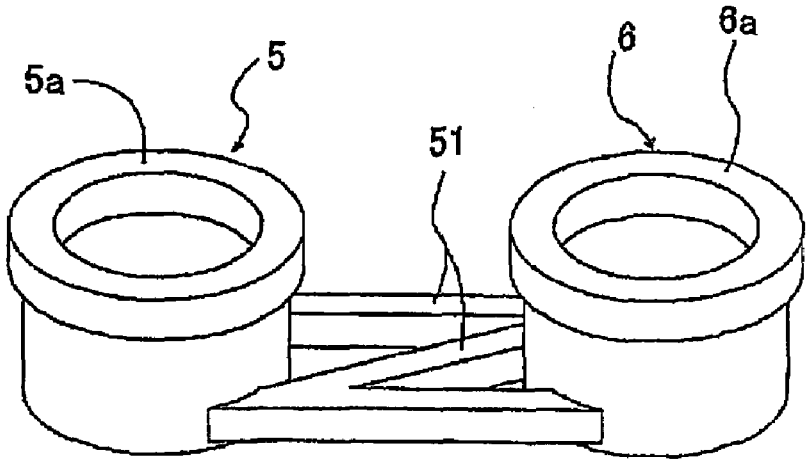
FIG. 28 is a perspective view of a plurality of cushion rings connected to each other by reinforcing structures according to another embodiment.
Figure 29:
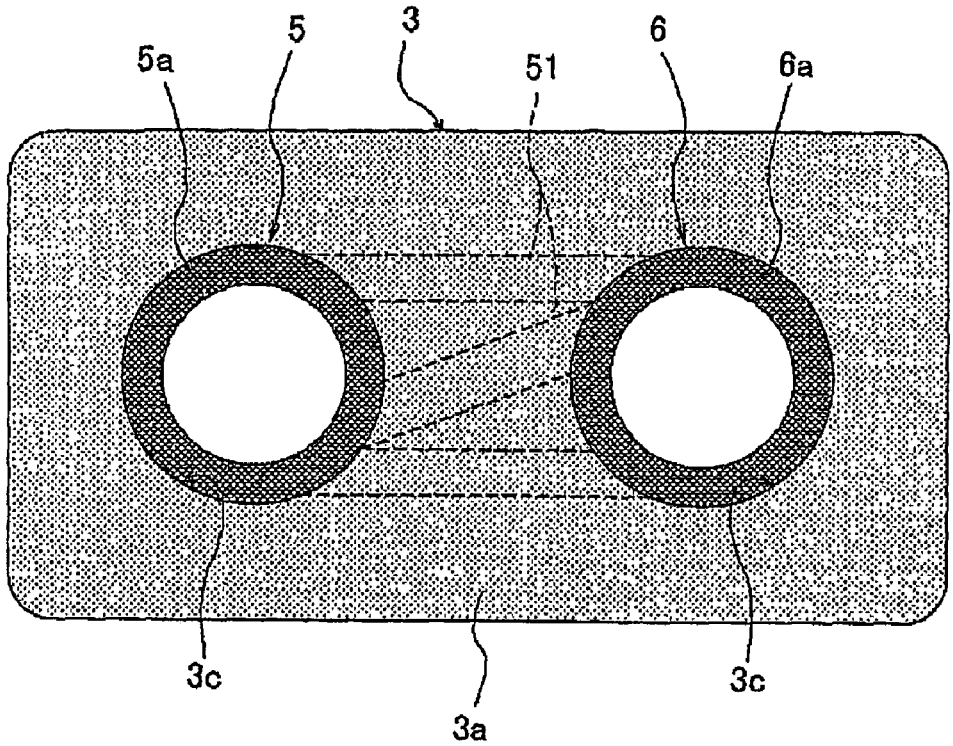
FIG. 29 is a plan view of the cushion rings, shown in FIG. 28, fitted to the punch.

FIGS. 28 and 29 illustrate an alternative plurality of cushion rings for a press molder, which are connected to each other by another reinforcing structure and slidably fitted to the punch.

The plurality of cushion rings shown in each of FIGS. 28 and 29 consist of a first cushion ring 5 and a second cushion ring 6. The second cushion ring 6 is not disposed inside the first cushion ring 5, but the first cushion ring 5 and the second cushion ring 6 adjoin each other.

The first cushion ring 5 and the second cushion ring 6 of this embodiment are also connected to each other by ribs 51 which are reinforcing structures, and the ribs 51 are disposed in lower portions of the first cushion ring 5 and the second cushion ring 6.

The first cushion ring 5 and the second cushion ring 6 connected to each other by the ribs 51 are slidably fitted into a hollow 3*c* formed in the punch 3.

By connecting the first cushion ring 5 and the second cushion ring 6 to each other by the ribs 51 which are reinforcing structures, the rigidity of the first cushion ring 5 and the second cushion ring 6 is improved so as to prevent the first cushion ring 5 and the second cushion ring 6 from bending and deforming at the time of the molding of the work piece W, and to suppress attitude-disarrangement of the first cushion ring 5 and the second cushion ring 6 at the time of the molding.

Accordingly, any crease or crack is prevented from being generated in the work piece W after the molding without any complicated adjustment work, thereby improving the accuracy of the molding.

Further, the first cushion ring 5 and the second cushion ring 6 are prevented from being bent by processing force during mechanical processing of the cushion ring 5 and the second cushion ring 6, thereby improving the accuracy of the mechanical processing thereof.

INDUSTRIAL APPLICABILITY

The present invention is widely applicable to a press molder so as to prevent bending of a cushion ring and improve the rigidity of the cushion ring.

The invention claimed is:

1. A press molder comprising:

a die;

a punch having a recess; and a cushion ring annularly disposed around the punch and compressible so as to follow a movement of the die, the cushion ring including a reinforcing structure preventing the cushion ring from being bent during press molding, the reinforcing structure comprising one of a rib, a reinforcing bar and a wire, formed within the recess of the punch connecting opposite sides of the cushion ring.

2. The press molder as set forth in claim 1, wherein the reinforcing structure is provided at a portion of the cushion ring opposite to a surface of the cushion ring to abut against the die.

3. The press molder as set forth in claim 1, wherein the reinforcing structure is a rib spanned in an opening of the cushion ring.

4. The press molder as set forth in claim 3, wherein the reinforcing rib is formed integrally with the cushion ring or fastened to the cushion ring by a fastening member.

5. The press molder as set forth in claim 1, wherein the reinforcing structure is a wire spanned in an opening of the cushion ring.

6. The press molder as set forth in claim 5, wherein the wire has adjustable tensile force.

7. The press molder as set forth in claim 1, further comprising: a downwardly extending leg part formed on a lower end of the punch; and an attachment hole, to which a hook member is attached, formed on a side surface of the punch, wherein, when the punch and the cushion ring are put on the same floor, the attachment hole is positioned above the cushion ring.

8. The press molder as set forth claim 1, further comprising:

a cushion pin disposed below the cushion ring so as to support a main body and the reinforcing structure of the cushion ring.

9. The press molder as set forth in claim 1, wherein the cushion ring comprises a plurality of cushion rings wherein the plurality of cushion rings are connected to each other through a reinforcing structure and the plurality of cushion rings are slidably engaged with the punch.

10. The press molder as set forth in claim 1, wherein the cushion ring comprises a plurality of cushion rings; one of the cushion rings is disposed around the punch; the other cushion ring is inserted in a cavity formed in the punch; and wherein the one of the cushion rings and the other cushion ring are connected to each other through a reinforcing structure.

11. The press molder as set forth in claim 9, wherein the reinforcing structure is provided at a position opposite to faces of cushion rings making contact with the die.

12. The press molder as set forth in claim 9, wherein the reinforcing structure is a rib formed between one of the cushion rings and the other cushion ring.

13. The press molder as set forth in claim 12, wherein the reinforcing rib is forted integrally with one of the cushion rings and the other cushion ring, or fastened to one of the cushion rings and the other cushion ring.

14. A cushion ring provided in a press molder, comprising:

a reinforcing structure for preventing the cushion ring from bending during press molding, the reinforcing structure comprising one of a rib, a reinforcing bar and a wire, formed within the recess of the punch connecting opposite sides of the cushion ring.

15. The cushion ring as set forth in claim 14, wherein the reinforcing structure is a rib spanned in an opening of the cushion ring.

16. The cushion ring as set forth in claim 14, wherein the reinforcing structure is formed integrally with the cushion ring or fastened to the cushion ring by a fastening member.

17. The cushion ring as set forth in claim 14, wherein the reinforcing structure is a wire spanned in an opening of the cushion ring.

18. The cushion ring as set forth in claim 17, wherein the wire has adjustable tensile force.

* * * * *